US012364298B2

(12) United States Patent
Coutelin

(10) Patent No.: US 12,364,298 B2
(45) Date of Patent: Jul. 22, 2025

(54) GARMENT POCKET AND METHOD OF MAKING SAME

(71) Applicant: Doreen Coutelin, Paradise Valley, AZ (US)

(72) Inventor: Doreen Coutelin, Paradise Valley, AZ (US)

( * ) Notice: Subject to any disclaimer, the term of this patent is extended or adjusted under 35 U.S.C. 154(b) by 0 days.

(21) Appl. No.: 16/854,187

(22) Filed: Apr. 21, 2020

(65) Prior Publication Data

US 2020/0337398 A1 Oct. 29, 2020

Related U.S. Application Data

(60) Provisional application No. 62/837,949, filed on Apr. 24, 2019.

(51) Int. Cl.
*A41D 27/20* (2006.01)

(52) U.S. Cl.
CPC ..... *A41D 27/20* (2013.01)

(58) Field of Classification Search
CPC ..... A41D 27/20; A41D 13/0012; A41B 9/00; A41C 3/00
USPC ..... 2/248
See application file for complete search history.

(56) References Cited

U.S. PATENT DOCUMENTS 1,448,252 A * 3/1923 Battista ..... A41D 27/20 2/247
2,388,516 A * 11/1945 Altobelli ..... A41D 27/202 112/475.25
2,510,919 A * 6/1950 Weiss ..... D06M 15/39 428/196
3,137,865 A 6/1964 Evans et al.
3,177,499 A * 4/1965 Evans ..... A41D 27/20 2/247
4,263,678 A * 4/1981 Off ..... A41D 27/20 2/247
5,105,473 A 4/1992 Valtakari
6,974,610 B1 * 12/2005 Koppes ..... A41D 31/32 428/32.81

(Continued)

FOREIGN PATENT DOCUMENTS

GB 2468175 A * 9/2010 ..... A41C 3/0035
GB 2529262 A * 2/2016 ..... A41D 27/20

*Primary Examiner* — Katherine M Moran
*Assistant Examiner* — Grady Alexander Nunnery
(74) *Attorney, Agent, or Firm* — Seyfarth Shaw LLP; Brian Michaelis

(57) ABSTRACT

A garment is provided in various styles and fits that includes an accessory pocket configured to comfortably accommodate and retain accessories, such as meditation crystals or stones in discrete pockets strategically placed at chakra locations within the garment. The accessory pocket comprises an elastic pocket opening in the garment fabric. The elastic pocket opening provides access to a pocket bag, dimensioned to accommodate an accessory, such as a chakra crystal. A color strip is implemented interior to the pocket and at least partially visible from an exterior of the pocket, corresponds to the accessory, e.g., indicates a particular chakra crystal that is appropriate to the particular pocket location. Particular chakra crystal pocket locations are selected to place chakra crystals in chakra locations corresponding to at least one of seven chakra locations.

6 Claims, 18 Drawing Sheets
(7 of 18 Drawing Sheet(s) Filed in Color)

(56) References Cited

U.S. PATENT DOCUMENTS 8,272,507 B1* 9/2012 Crump ..... A45F 5/02 206/223
8,597,072 B1* 12/2013 Lucas ..... A41C 3/0035 2/247
10,342,310 B1* 7/2019 Kutting ..... A45C 13/02
2002/0100108 A1* 8/2002 Stuart ..... A41D 13/0015 2/247
2003/0182705 A1* 10/2003 Spongberg ..... A41D 1/00 2/69
2004/0255360 A1* 12/2004 Bass ..... A41D 13/1245 2/69
2005/0133130 A1* 6/2005 Blum ..... A45F 5/02 150/134
2007/0028349 A1 2/2007 Watson
2011/0061146 A1 3/2011 Spiewak et al.
2012/0064313 A1* 3/2012 Rock ..... B32B 7/02 428/212
2013/0139297 A1* 6/2013 Crump ..... A45F 5/00 2/247
2013/0225042 A1 8/2013 Ave et al.
2014/0182044 A1 7/2014 Cole
2014/0259306 A1* 9/2014 Shinn ..... A41B 9/04 2/406
2014/0283283 A1 9/2014 Chumbler
2015/0007379 A1 1/2015 Cockram
2016/0015103 A1* 1/2016 Gray ..... A41D 27/20 2/114
2016/0238347 A1* 8/2016 Blauer ..... A41D 3/005
2016/0287928 A1* 10/2016 Darnell ..... A63B 21/4037
2017/0164668 A1* 6/2017 Bersamin ..... A41D 27/201
2018/0193687 A1* 7/2018 Petrakis ..... A63B 21/4005
2018/0228232 A1* 8/2018 Fisher ..... A41F 9/025
2019/0015046 A1 1/2019 Whitehouse et al.

* cited by examiner

GARMENT POCKET AND METHOD OF MAKING SAME

RELATED APPLICATIONS

This application claims priority to U.S. Provisional Patent Application No. 62/837,949 filed on Apr. 24, 2019, which is incorporated by reference herein.

TECHNICAL FIELD

The present application relates to leisure-ware clothing, and in particular to garments for use in yoga and/or meditation.

BACKGROUND

Wellness brand clothing articles are known, for example for use in exercising, yoga and/or meditation. "Athleisure clothing," as such garments may be called, are aimed at a variety of markets, and implement designs that not only address the visual manifestation of a concept, but also the physical elements required in garments capable of being worn during various levels of activity. Comfort and fit are important considerations, regardless of concept. For garments that involve accessories associated with the garment and concept, fit, and accommodation and integration of the accessories are often not easily achieved.

SUMMARY

Garments according to the disclosure provide yoga and meditation clothing that implement fit and comfort, and integrate accessories in the form of meditative crystals in a comfort and retention pocket that integrates the crystal accessory in a design that visually matches the meaning and pertinent location of the crystal accessory.

According to the disclosure, athleisure clothing, such as a meditation or yoga garment, is provided in various styles and fits that include at least one accessory pocket configured to comfortably accommodate and retain meditation crystals or stones in discrete pockets strategically placed at chakra locations within garments where stones may be placed for maximum benefit.

The at least one accessory pocket comprises an elastic pocket opening in the form of a slit, e.g., a silicone slit in the garment fabric. The elastic pocket opening provides access to a pocket bag, dimensioned to accommodate and retain a chakra crystal. A color strip is implemented interior to the pocket and is at least partially visible from an exterior of the pocket, to indicate a particular chakra crystal or stone that is appropriate to the particular pocket location.

Particular chakra crystal pocket locations are selected to place chakra crystals in chakra locations corresponding, i.e. proximate in location, to at least one of seven chakra glands. The crystal pockets will be placed over, i.e. proximate to, at least one of the chakra glands, including a Root chakra crystal pocket over the prostate or skene gland, a Sacral chakra crystal pocket over ovaries/testis (Gonads), a Solar chakra crystal pocket over the pancreas/adrenal gland, a Heart chakra crystal pocket over the thymus gland, a Throat chakra crystal pocket over the thyroid gland, a Brow chakra crystal pocket over the pituitary gland, and a Crown chakra crystal pocket over pineal gland.

Color strips corresponding to the foregoing particular chakra crystal or stone and location are implemented interior to the particular chakra pocket, and are at least partially visible from the exterior of the pocket. The color strips, to indicate the chakra stone/crystal appropriate to the particular pocket location, may include: Purple, Dark Blue, Light Blue, Light Green, Yellow, Light Blue, Green, Yellow, Orange, or Red.

Further, multiple pockets may be located over a chakra gland. The pockets may be separate or formed of a single pocket including a divider. As a result, multiple crystals of the same or different type may be placed over a chakra gland without coming into contact with each other.

The accessory pocket may alternatively be configured to adhere directly to the body proximate to the chakra gland if preferred. A further embodiment of the accessory pocket may be applied as a patch to personal accessories. Additionally, the accessory pocket may include an adhesive for placement by a practitioner on an athleisure clothing article. As a result, a practitioner may locate the accessory pocket in a location more aligned with their personal chakra structure.

A further embodiment of the accessory pocket may be applied as a patch to personal accessories such as, but not limited to, water bottles, towels, yoga mats, pocketbooks, handbags, and wallets.

The above summary has outlined, rather broadly, some features and advantages of the present disclosure in order that the detailed description that follows may be better understood. Additional features and advantages of the disclosure will be described below. It should be appreciated by those skilled in the art that this disclosure may be readily utilized as a basis for modifying or designing other structures for carrying out the same purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further objects and advantages, will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

For a more complete understanding of the present disclosure, reference is now made to the following description taken in conjunction with the accompanying drawings.

DETAILED DESCRIPTION

The detailed description set forth below, in connection with the appended drawings, is intended as a description of various configurations and is not intended to represent the only configurations in which the concepts described herein may be practiced. The detailed description includes specific details for the purpose of providing a thorough understanding of the various concepts. It will be apparent to those skilled in the art, however, that these concepts may be practiced without these specific details. In some instances, well-known structures and components are shown in block diagram form in order to avoid obscuring such concepts. As described herein, the use of the term "and/or" is intended to represent an "inclusive OR", and the use of the term "or" is intended to represent an "exclusive OR".

Garments according to the disclosure provide athleisure clothing, such as yoga and meditation clothing, that implement fit and comfort, and integrate accessories in the form of meditative crystals in a comfort and retention pocket. The comfort and retention pocket integrates the crystal accessory in a garment and pocket design that visually matches the meaning and pertinent location of the crystal accessory.

According to the disclosure, a meditation and yoga garment is provided in various styles and fits that include at least one accessory pocket configured to comfortably accommodate and retain meditation crystals or stones in discrete pockets strategically placed at chakra locations within garments where stones/crystals may be placed for maximum benefit.

Garment fabric, for athleisure clothing according to the disclosure, that may be used for meditation and/or yoga, may be made from an inner shell, made for example of heavyweight poly-spandex knit, content: 76% polyester, 24% Spandex. Outer (or inner) layer panels may be selectively located and formed of wicking materials, such as stretch mesh lace constructed of 93% polyester and 7% Spandex. It should be appreciated that more or less than two layers may be implemented as a function of the garment. Similarly, other materials may be implemented depending on the nature and function of the garment (e.g., cover-ups may be made of loose-fitting cotton, processed bamboo or hemp, rather than polyester and/or Spandex materials that may be used in athleisure exercise garments). Accessory pockets as described herein may be implemented in garments having any of various numbers of layers, and made of various other materials, without departing from the scope of this disclosure.

Figure 1:
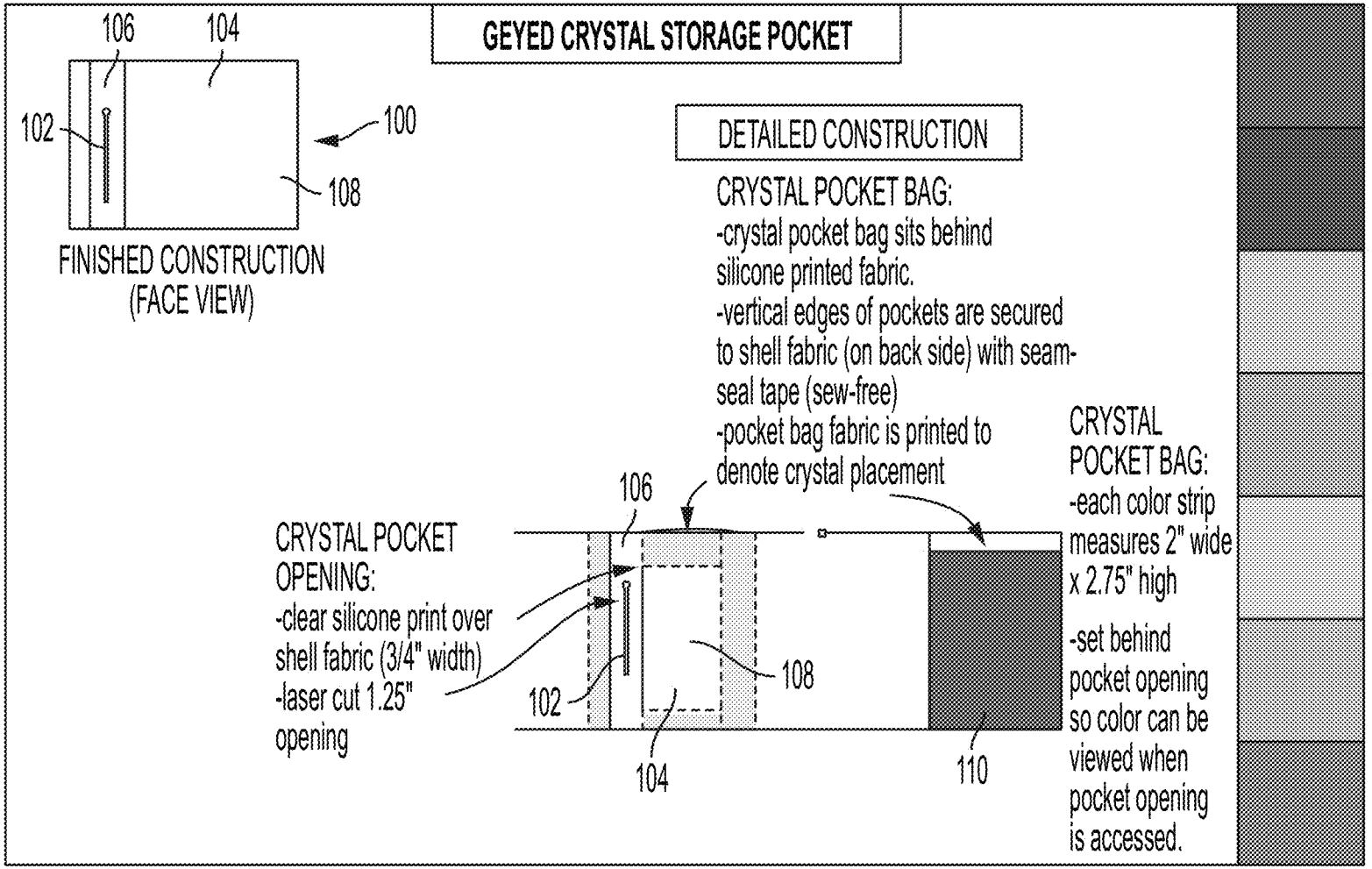
FIG. 1 illustrates a block diagram of an embodiment of a chakra crystal pocket construction and color strip or insert scheme for fixing to a meditation/yoga garment according to the disclosure.

As illustrated in FIG. 1, the accessory pocket 100 comprises an elastic pocket opening or slit 102 for access and closure of a pocket according to the disclosure. In an embodiment, the elastic pocket slit may be implemented in the form of a silicone slit adhered to an outer shell fabric 104 such as the garment fabric. The silicone slit 102 may take the form of a strip 106 of clear silicone material, e.g., of a width of approximately ¾ inch, printed over (or otherwise adhered to) the outer shell fabric 104. The slit 102 may be laser cut through both the silicone strip and underlying shell(s) material. It should be appreciated that other flexible material may be used to implement a flexible slit that flexes to receive a stone or crystal through the slit, such as other polymeric materials, thin film rubber or the like, and that the slit may be other than laser cut through the silicone strip (e.g., by scissor, knife or other mode of manual or machine cutting). Similarly, rather than flexible, resilient opening and closure, the pocket slit may be implemented with other passive or active closure mechanisms, including but not limited to hook and pile, plastic or polymer zipper mechanisms, resealable synthetic (or organic) fiber fastener tape, extruded arrowhead-and-channel interlock systems, or the like.

The elastic pocket opening or slit 102 provides access to a pocket bag, 108 formed behind and beneath the pocket slit 102. The pocket bag 108 may be dimensioned to accommodate a chakra crystal or stone.

For example, the pocket bag in an illustrative embodiment may be approximately 2.25 inches wide by 3.00 inches in length. The pocket bag may be formed by securing edges of elastic pocket material onto the back (interior side) of the shell material 104 with seam-seal tape. The pocket material may be padded on the inside or be of a thickness that minimizes the presence of the accessory against the wearer's body. A color strip 110 may be configured to adhere into the interior of the pocket bag 108, For example, the color strip 110 may be dimensioned to be approximately 2 inches by 2.75 inches and to be adhered to the pocket bag material. The color strip may be adhered to the interior of the pocket bag material before the pocket bag material edges are secured to the interior side of the shell material 104. Alternatively, the color strip may be a particular color printed, dyed or otherwise disposed on the interior of the pocket bag material as a part of the pocket bag material interior.

The color strip 110 is implemented interior to the pocket and is at least partially visible from an exterior of the pocket, for example through the slit 102. The color strip provides a color code for location of an accessory corresponding to the location. In this embodiment the color strip 110 is a color to indicate a particular chakra crystal or stone that is appropriate to the particular pocket location. That is, the color strip corresponds to the particular chakra crystal or stone that is to be located in that particular pocket location that corresponds to that particular chakra gland/location. The color strips, to indicate the chakra stone/crystal appropriate to the particular pocket location, may include: Purple, Dark Blue, Light Blue, Light Green, Yellow, Light Blue, Green, Yellow, Orange, or Red.

FIGS. 2-14, illustrate various designs of garments, having accessory pockets in selected location(s) on a garment panel. Particular chakra crystal pocket locations are selected to place chakra crystals in chakra locations corresponding to at least one of seven chakra glands. The crystal pockets are located to place a corresponding chakra crystal over or proximate to at least one of the chakra glands, including a Crown chakra crystal pocket (interior purple) proximate to the pineal gland, a Third Eye (or Brow) chakra crystal pocket (interior dark blue) proximate to the pituitary gland, a Throat chakra crystal pocket (interior light blue) proximate to the thyroid gland, a Heart chakra crystal pocket (interior light green) proximate to the thymus gland, a Solar plexus chakra crystal pocket (interior yellow) proximate to the pancreas/adrenal gland, a Sacral chakra crystal pocket (interior orange) proximate to ovaries/testis (Gonads), and a Root chakra crystal pocket (interior red) proximate to the prostate or skene gland.

Figure 2:
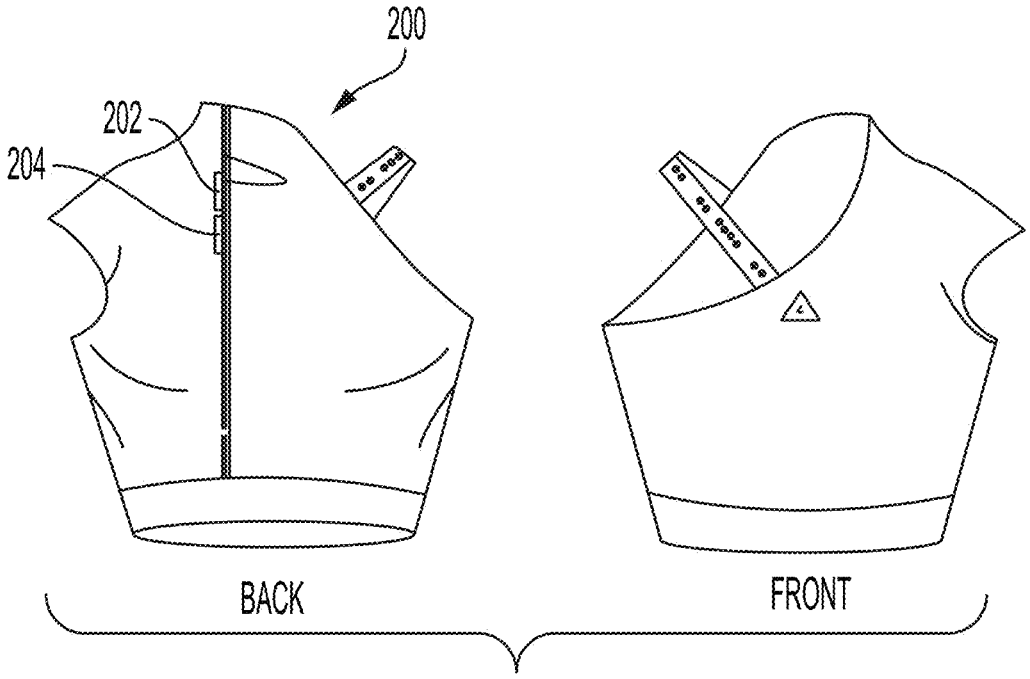
FIGS. 2 through 14 illustrate various meditation/yoga garment types incorporating chakra pockets for crystal storage according to the disclosure.

FIG. 2 illustrates a long bra wrap garment 200, and shows a front and back of the garment. The wrap garment includes two accessory or crystal pockets, 202 and 204, in this embodiment. In particular, this embodiment may include a Solar plexus crystal pocket 202 (i.e. interior yellow) and a heart chakra crystal pocket 204 (i.e. interior light green).

Figure 3:
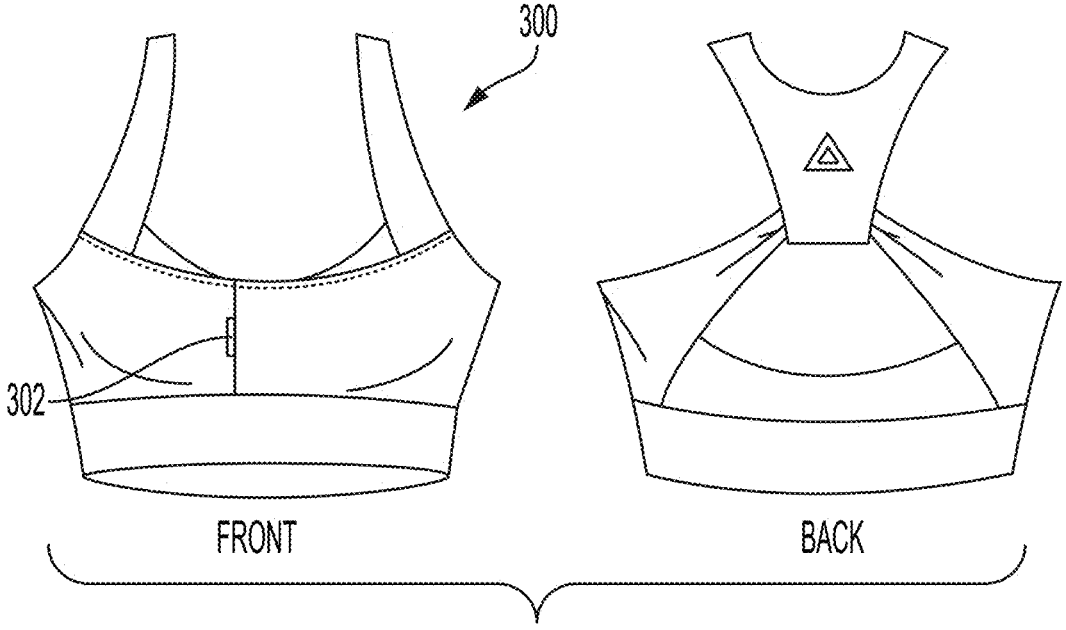

FIG. 3 illustrates a bra top garment 300, and shows a front and back of the garment. The top 300 garment includes one accessory or crystal pocket, 302, in this embodiment. In particular, this embodiment may include a heart chakra crystal pocket 302 (i.e. interior light green).

Figure 4:
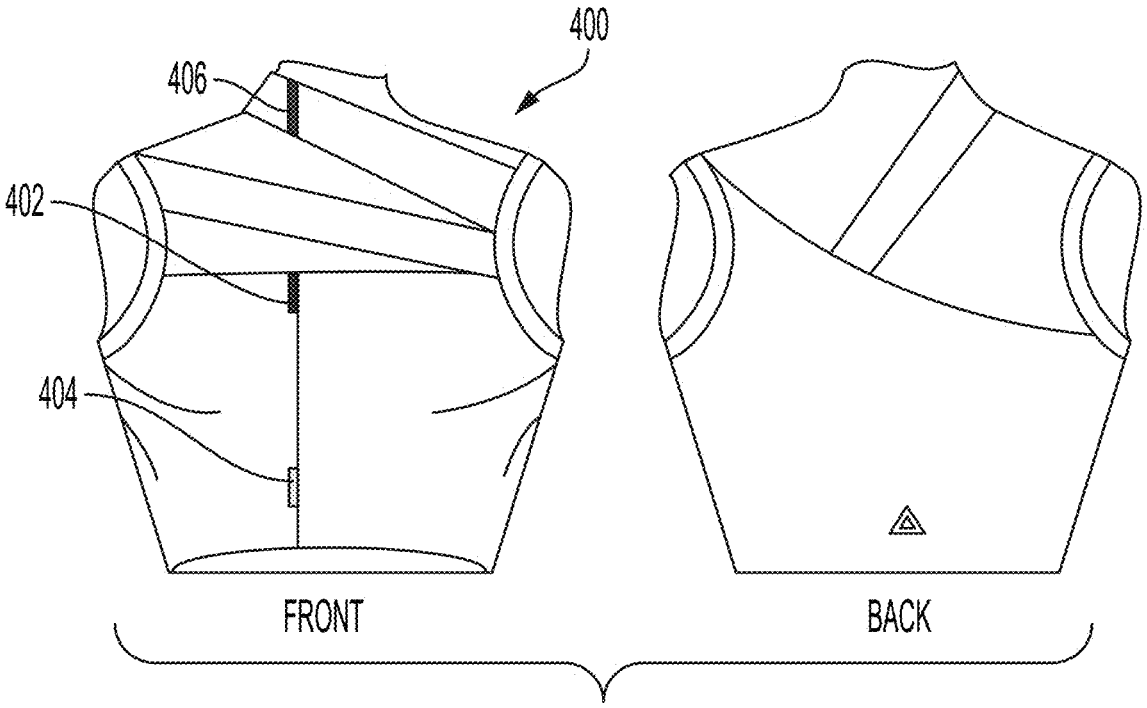

FIG. 4 illustrates an asymmetrical long bra garment 400, and shows a front and back of the garment. The long bra garment includes three accessory or crystal pockets, 402, 404 and 406, in this embodiment. In particular, this embodiment may include a Solar plexus crystal pocket 402 (i.e. interior yellow) and a heart chakra crystal pocket 404 (i.e. interior light green). This embodiment may also include a Throat chakra crystal pocket 406 (interior light blue) proximate to the thyroid gland.

Figure 5:
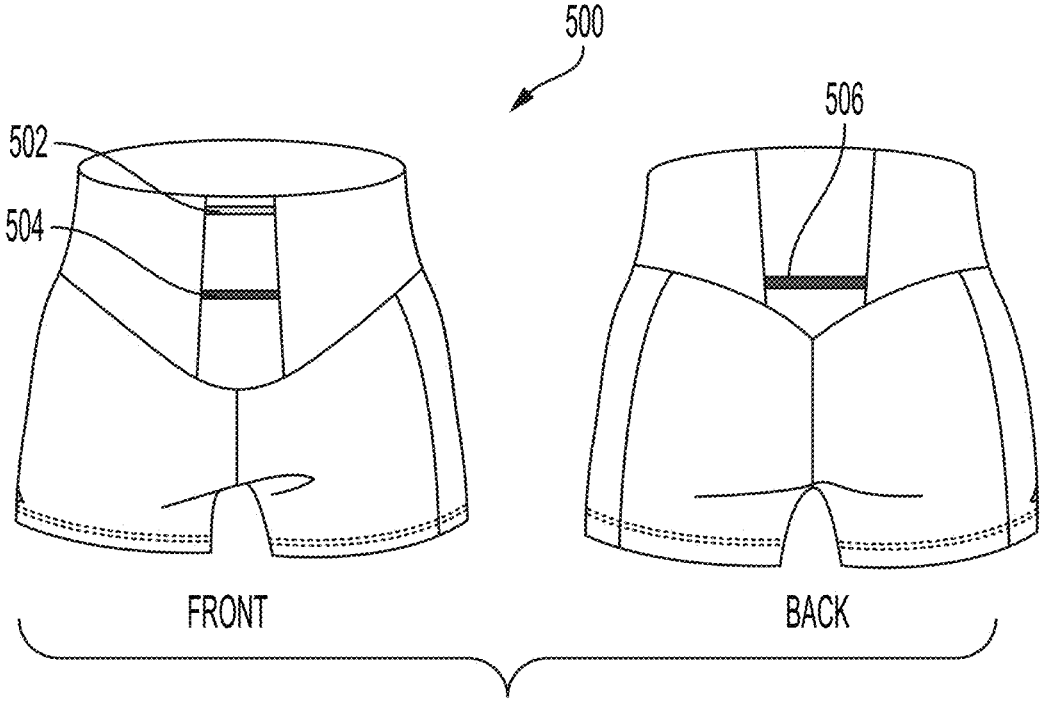

FIG. 5 illustrates four inch shorts garment 500, and shows a front and back of the garment. The shorts garment includes three accessory or crystal pockets, 502, 504 and 506, in this embodiment, with two pockets in the front 502 and 504, and one in the back 506. In particular, this embodiment may include a Solar plexus crystal pocket 502 (i.e. interior yellow) located in the front as well as a Root chakra crystal pocket 504 (interior red) proximate to the prostate skene gland. This embodiment may also include a Root chakra crystal pocket 506 (interior red) proximate to the prostate or skene gland in the back of the garment 500.

Figure 6:
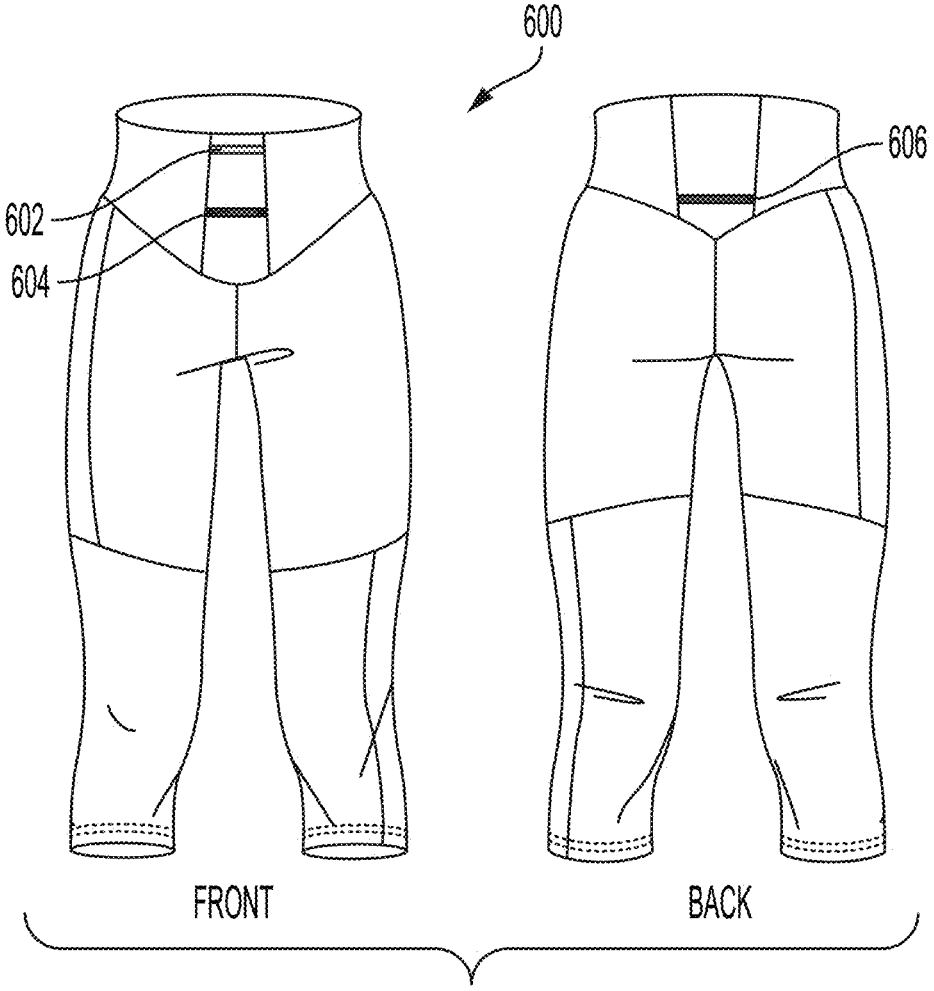
Figure 7:
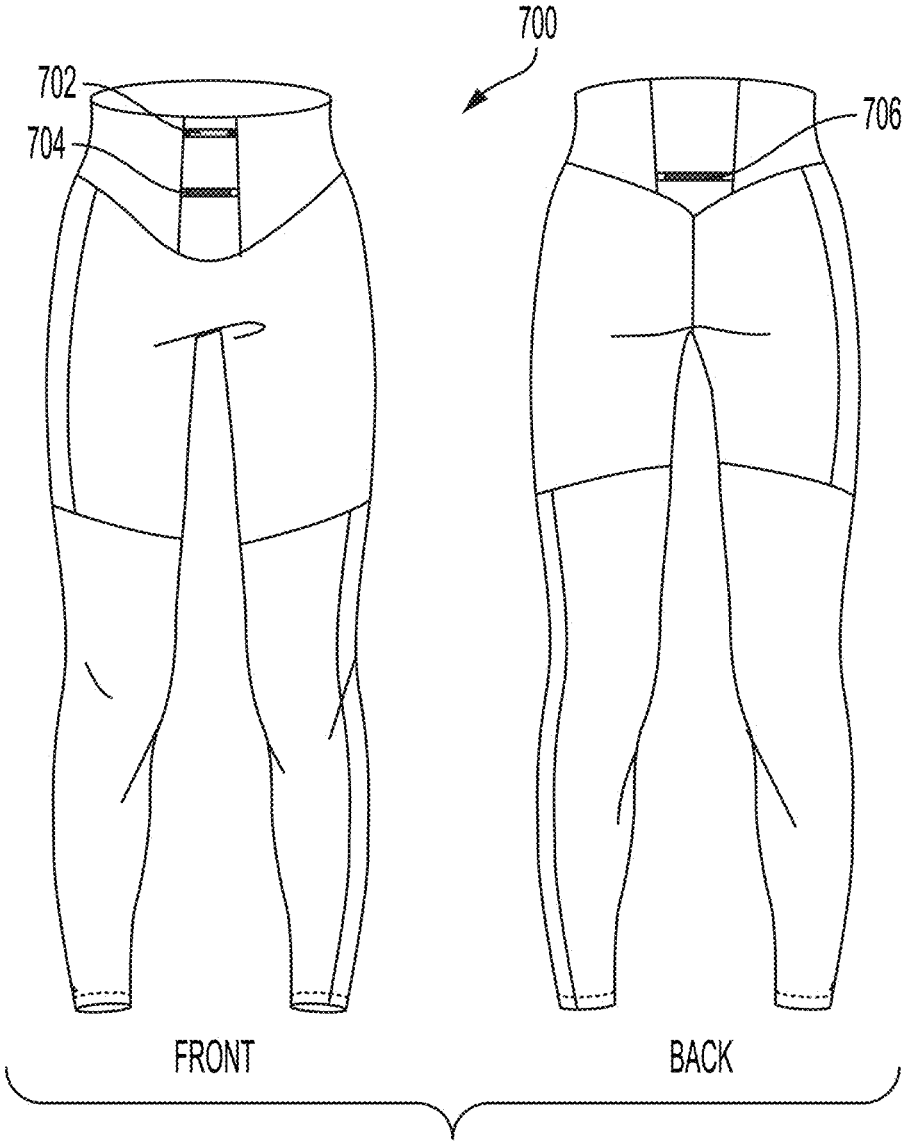

FIG. 6 and FIG. 7 illustrate a Capris pants garment 600 and leggings 700, respectively. Fronts and backs of the garments are shown. These garments 600, 700 both include three accessory or crystal pockets, 602/702, 604/704 and 606/706, in these embodiments, with two pockets in the front 602/702 and 604/704, and one in the back 606/706. In particular, these embodiments may include Solar plexus crystal pockets 602/702 (i.e. interior yellow) located in the front as well as a Root chakra crystal pockets 604/704 (interior red) proximate to the prostate skene gland. These embodiments may also include Root chakra crystal pockets 606/706 (interior red) proximate to the prostate or skene gland in the back of the garments 600/700.

Figure 8:
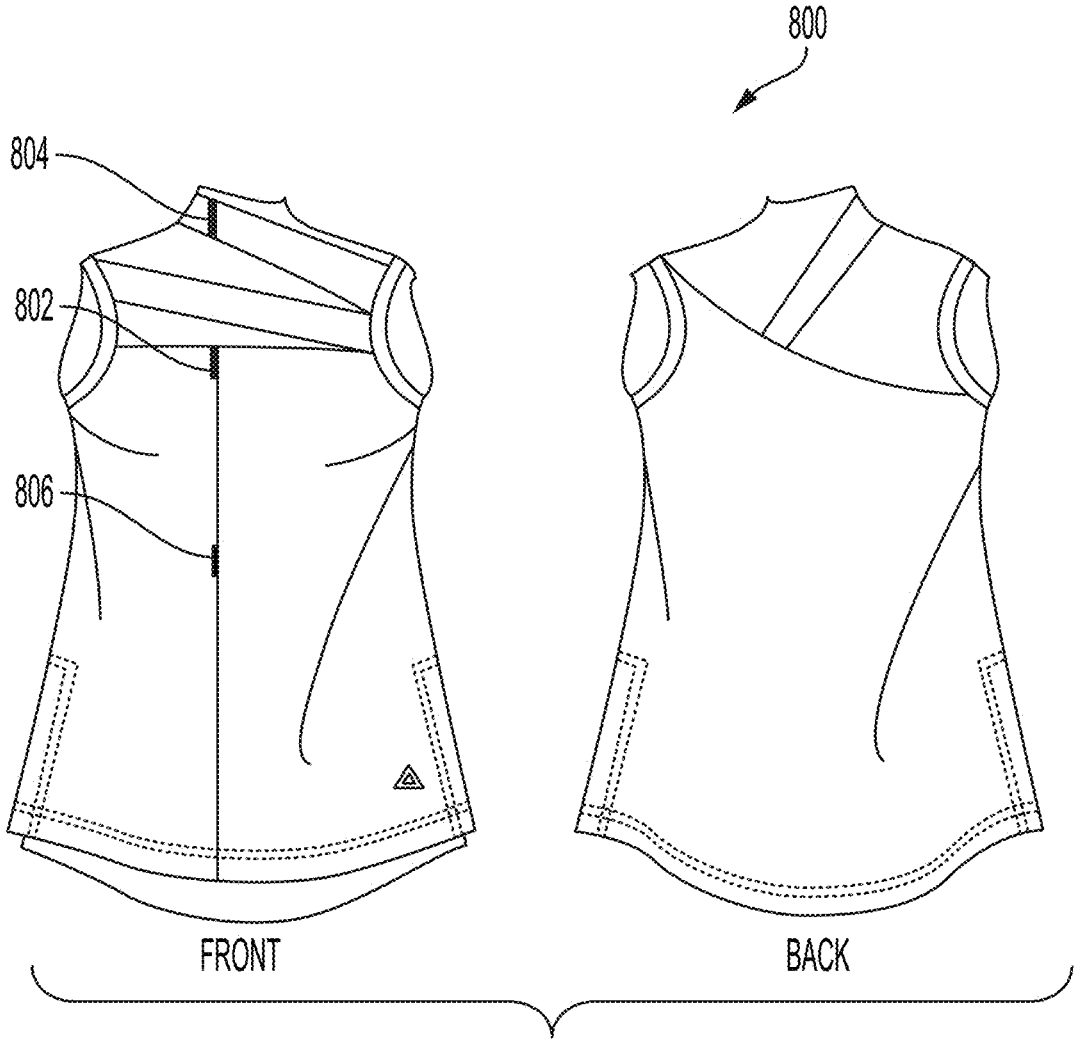

FIG. 8 illustrates a lifestyle cover-up garment 800, and shows a front and back of the garment. The cover-up garment 800 includes three accessory or crystal pockets, 802, 804 and 806, in this embodiment, all pockets being in the front. In particular, this embodiment may include a Solar plexus crystal pocket 806 (i.e. interior yellow) located in the front as well as a Throat chakra crystal pocket 804 (interior light blue) proximate to the thyroid gland, and a heart chakra crystal pocket 802 (i.e. interior light green).

Figure 9:
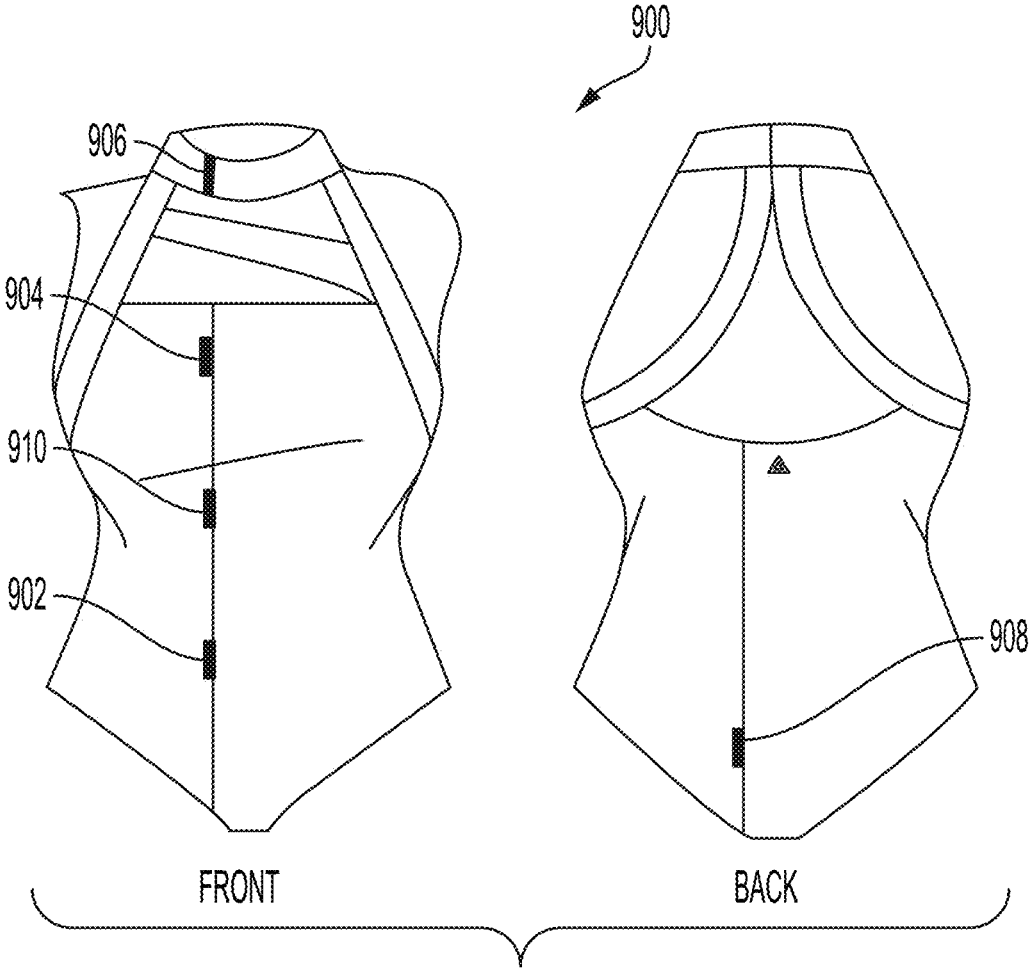

FIG. 9 illustrates a leotard garment 900, and shows a front and back of the garment. The leotard garment includes four accessory or crystal pockets, 902, 904, 906 and 910, in this embodiment. In particular, this embodiment may include a Solar plexus crystal pocket 910 (i.e. interior yellow) as well as a Throat chakra crystal pocket 906 (interior light blue) proximate to the thyroid gland, a Heart chakra crystal pocket 904 (i.e. interior light green), and a Sacral chakra crystal pocket 902 (i.e. interior orange). This embodiment may also include a Root chakra crystal pocket 908 (interior red) proximate to the prostate or skene gland in the back of the garment 900.

Figure 10:
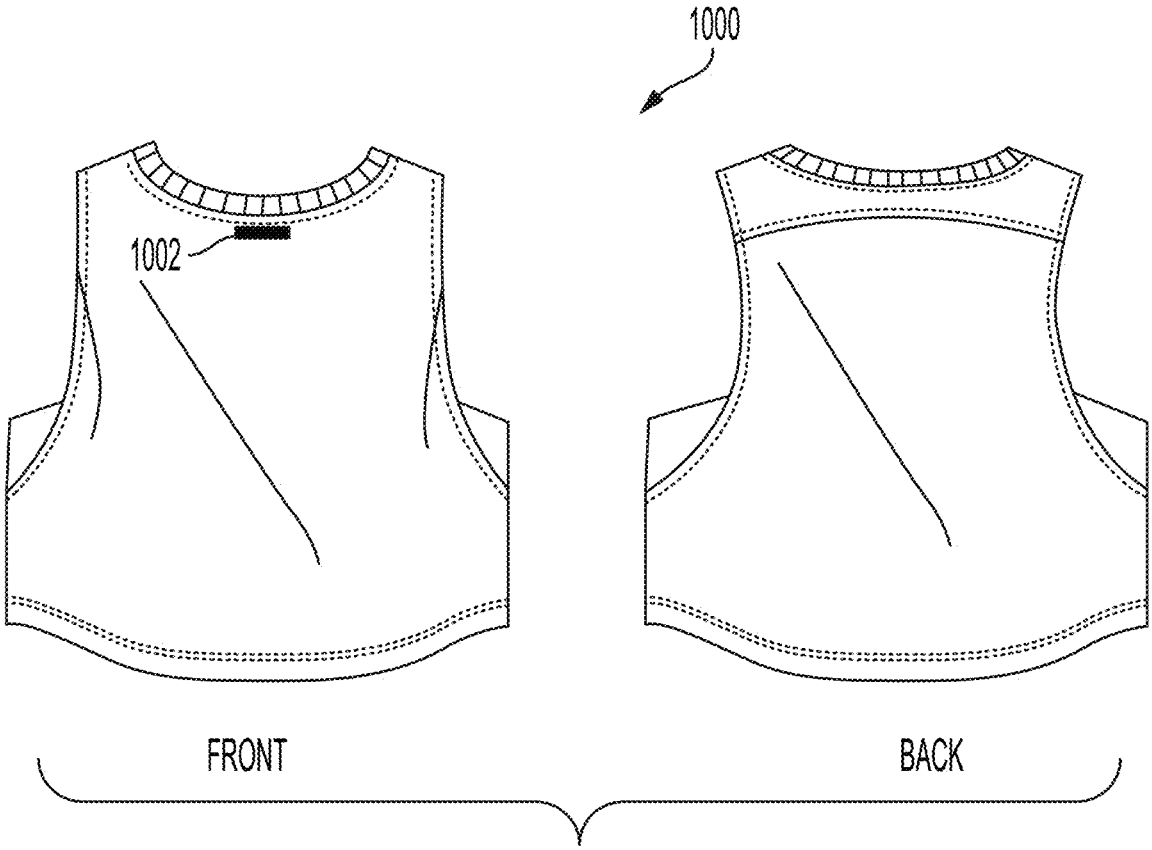

FIG. 10 illustrates a loose fitting tee garment 1000, and shows a front and back of the garment. The tee garment 1000 includes one accessory or crystal pocket, 1002, in this embodiment. In particular, this embodiment may include a heart chakra crystal pocket 1002 (i.e. interior light green).

Figure 11:
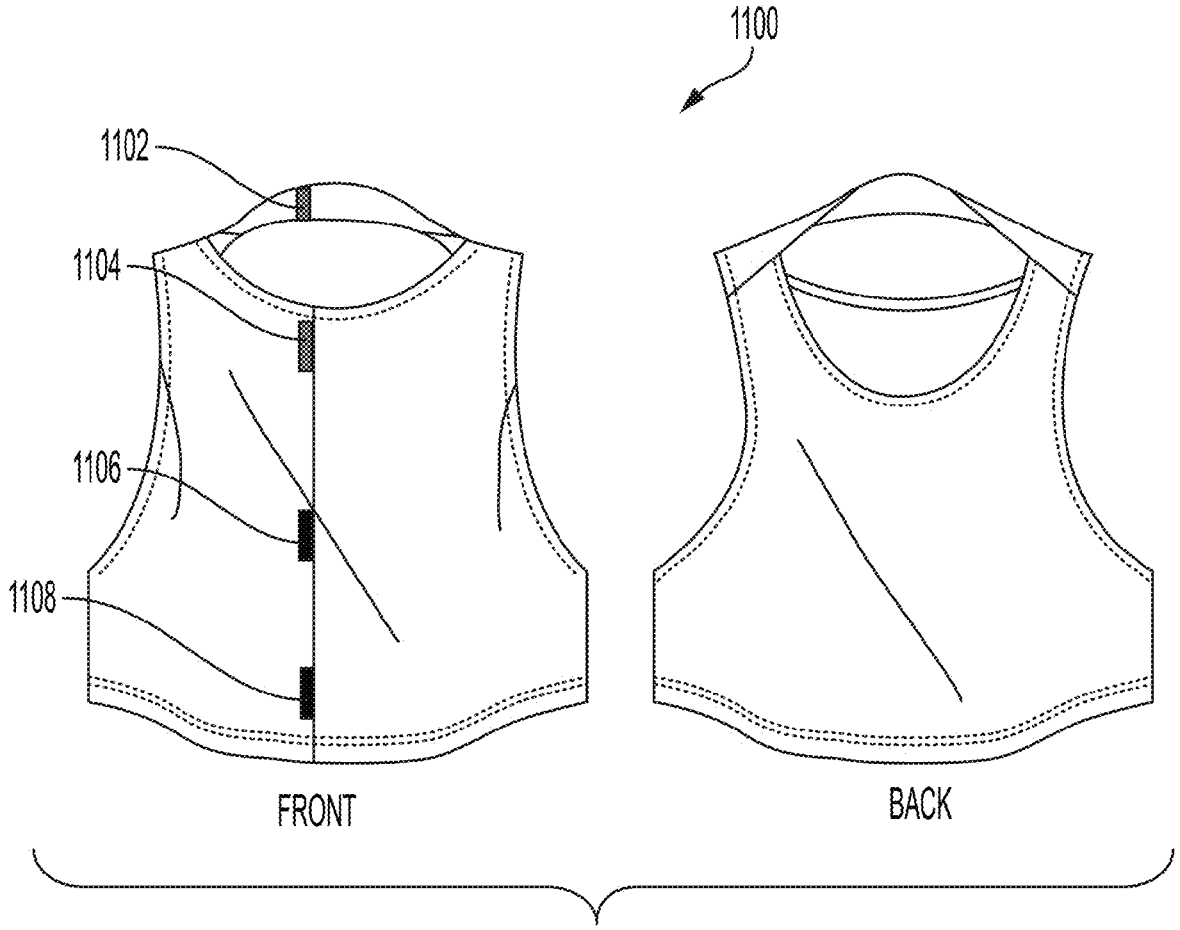

FIG. 11 illustrates a cropped tee garment 1100, and shows a front and back of the garment. The cropped tee garment includes four accessory or crystal pockets, 1102, 1104, 1106 and 1108, in this embodiment. In particular, this embodiment may include, all on the front side, a Throat chakra crystal pocket 1102 (interior light blue) proximate to the thyroid gland, a Heart chakra crystal pocket 1104 (i.e. interior light green), a Solar plexus crystal pocket 1106 (i.e. interior yellow), as well as a Sacral chakra crystal pocket 1108 (i.e. interior orange). A sweatshirt garment (not shown, but essentially analogous to the tee garment but with long sleeves in a shirt form), could be similarly configured with all but the Throat chakra crystal pocket because the sweatshirt does not extend to the thyroid gland region, so would only accommodate three pockets on its front, specifically the Heart chakra crystal pocket proximate to the heart (i.e. interior light green), the Solar plexus crystal pocket, and Sacral chakra crystal pocket (i.e. interior orange).

Figure 12:
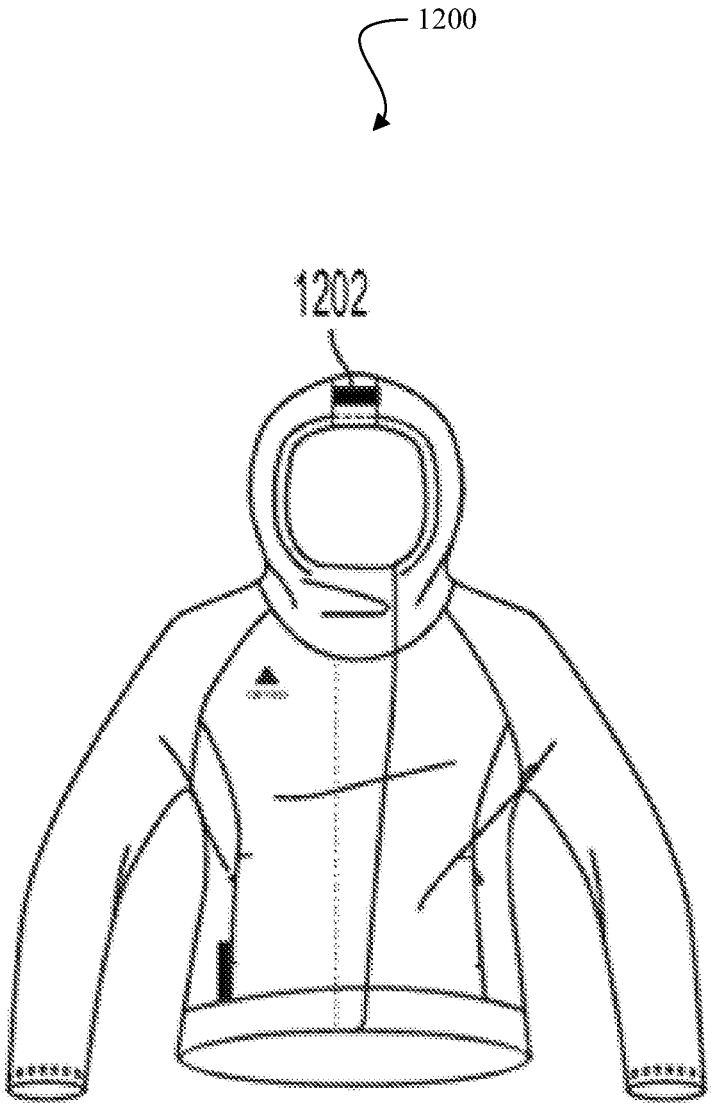
Figure 13:
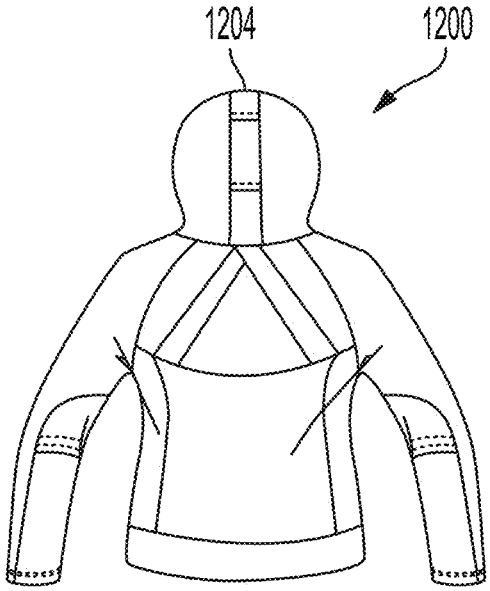

FIGS. 12 and 13 illustrate chakra pocket placement for Crown and Third Eye chakra crystals, in a hooded sweatshirt or soft-shelled jacket garment. In particular, these figures illustrate a Third Eye (or Brow) chakra crystal pocket 1202 (interior dark blue) proximate to the pituitary gland, and a Crown chakra crystal pocket 1204 (interior purple) proximate to the pineal gland. It should be appreciated that, although not shown in FIGS. 12 and 13, the hooded sweatshirt or soft-shelled jacket garment therein may be configured with all 7 chakra pockets, positioned as described and illustrated herein with respect to FIGS. 2-11 (some of which may be hidden, for example, behind a front flap of the jacket).

Figure 14:
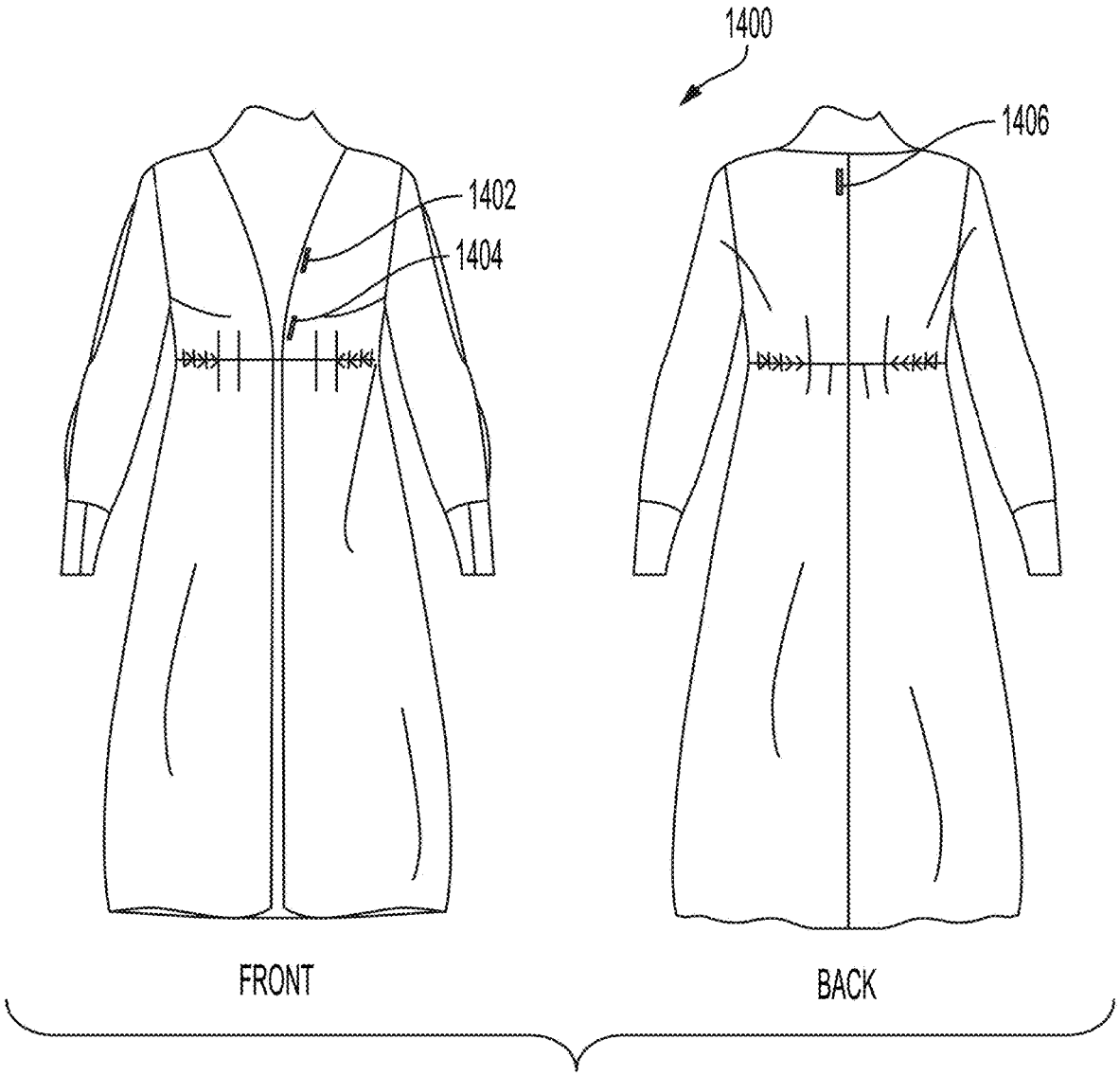

FIG. 14 illustrates a yoga cover-up garment 1400, and shows a front and back of the garment. The yoga cover-up garment includes three accessory or crystal pockets, 1402, 1404 and 1406, in this embodiment, with two pockets in the front 1402 and 1404, and one in the back 1406. In particular, this embodiment may include a Heart chakra crystal pocket 1402 (i.e. interior light green), and a Solar plexus crystal pocket 1404 (i.e. interior yellow) located in the front. This embodiment may also include a Throat chakra crystal pocket 1406 (interior light blue) proximate to the thyroid gland in the back of the garment 1400.

Although particular garments are illustrated herein, with particular pocket locations, it should be appreciated that pockets may be located on the front and/or back of garments according to the disclosure. Further, more or fewer chakra pockets may be implemented in any given garment. For example, although the hooded sweatshirt or jacket described herein illustrates Crown and Third Eye chakra pockets, the garment may accommodate other accessory pockets as a function of the area(s) covered by the garment.

Figure 15:
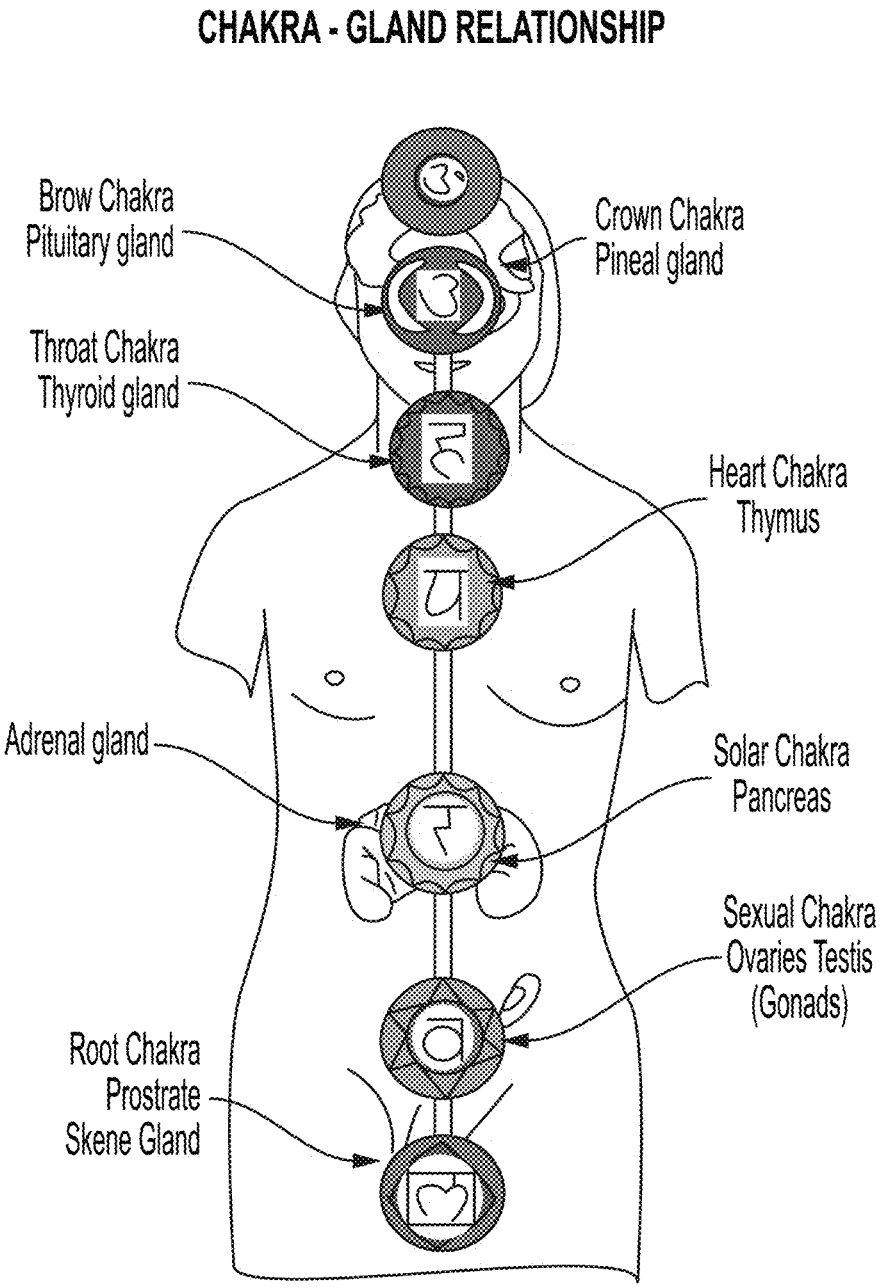
FIG. 15 PRIOR ART
FIG. 15 is a chakra gland crystal color chart depicting appropriate crystal colors for chakra locations.

It should be appreciated that wearers of garments according to the disclosure may need to be aware of imbalance in their body and/or energy, and place crystals near the chakra with the intention of healing and balancing chakras of the wearer. FIG. 15 generally illustrates chakra gland relationships. It should be appreciated that chakra locations do not need to be precise or colors exact or as disclosed herein, in order to be within the scope of this disclosure.

Figure 16:
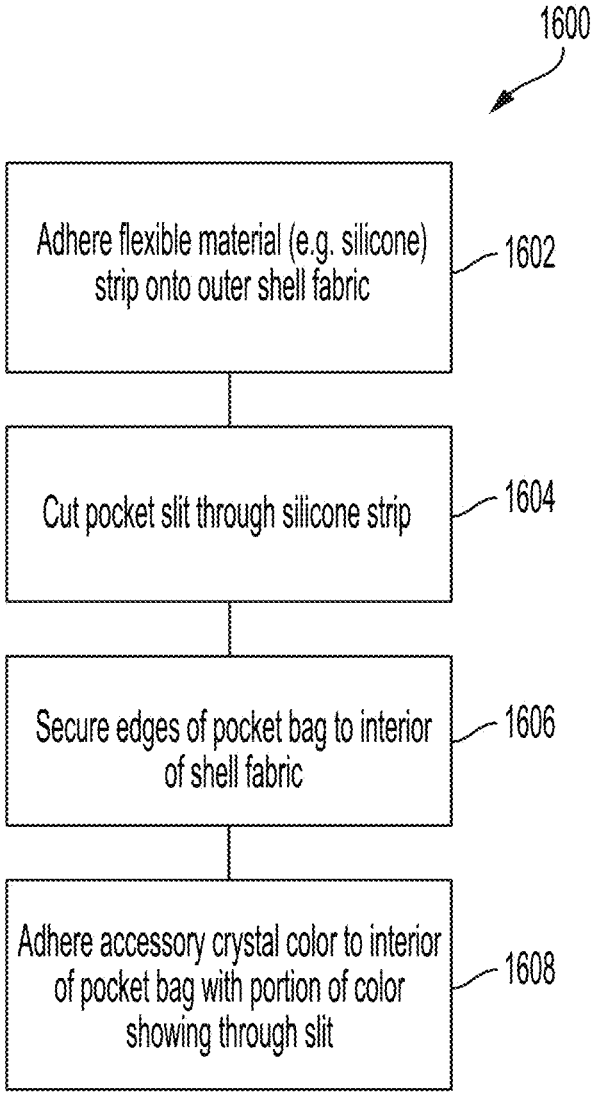
FIG. 16 is a block diagram illustrating steps that may be implemented in constructing a crystal storage pocket on a garment according to an embodiment of the disclosure.

FIG. 16 illustrates steps in a process 1600 for creating an accessory or crystal storage pocket according to the disclosure. In a step, 1602, flexible and resilient material such as silicone is adhered to the outer shell fabric (again, other pocket access and closure mechanisms may be implemented). A pocket slit may then be cut, in a step 1604, through the flexible and resilient material and shell to provide access to the pocket. Edges of a pocket bag may be secured to the interior of an inner shell of the garment, in a step 1606, to construct the pocket bag behind and accessible through the pocket slit. It should be appreciated that the pocket bag may be secured by any of various attachment mechanisms including adhesives, sewing or other threaded attachments, claps, mechanical fixtures (removable or non-removable) or the like. Accessory or crystal color may be adhered to the interior of the pocket bag, in a step 1608, again by any of various adhering approaches as described herein (such as dyeing of interior fabric, placement of a color strip, use of a fitted color fabric, or the like). It is desirable that a portion of the color strip be visible via the pocket slit, as described. It should be appreciated that the foregoing steps do not need to necessarily be performed in the order described, and one skilled in the art will appreciate that the order is not essential.

According to the disclosure, stones or crystals are such that they have different messages and energy associated with the stones/crystals. It should be appreciated that such spiritual nature may be associated with different shapes, colors, and/or textures, other than as described herein.

Other crystals associated with crystal energy healing may drive the inspiration of the clothing/garments, and placement of pockets and color strips for corresponding stones/crystals. Each article of clothing may have a target theme and the stones and intentions will revolve around the theme, for example a protection theme may help to protect the personal energy field, to protect the environment around the wearer, to cleanse stagnant or negative energy, and/or to transform negative energy into positive energy, helping you to build up an emotional resilience. Different colors and/or textures may be implemented accordingly.

Figure 17:
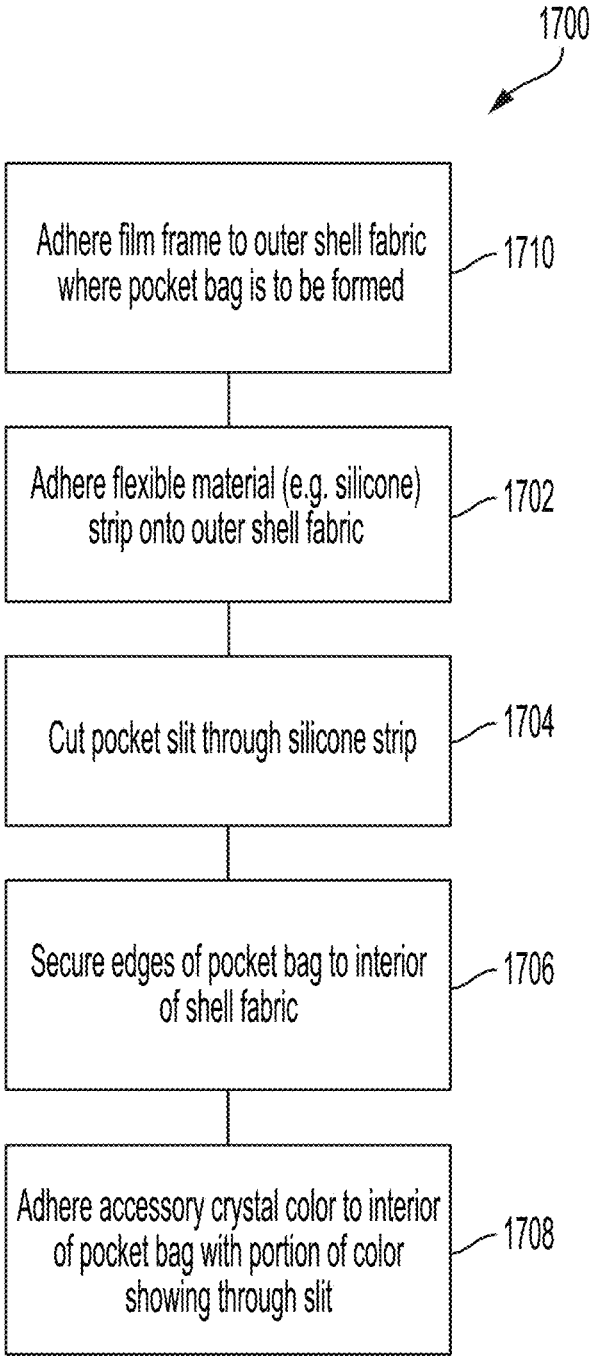
FIG. 17 is a block diagram illustrating steps that may be implemented in constructing a crystal storage pocket according to a further embodiment of the disclosure.

FIG. 17 illustrates a further embodiment of a process 1700 for creating an accessory or crystal storage pocket or patch according to the disclosure. In a preliminary additional step 1710, a frame may be provided, such as being applied to the outer shell fabric where the pocket bag is to be formed. The remaining steps in the process 1700 for creating an accessory or crystal storage pocket according to the disclosure are largely as described hereinbefore with respect to FIG. 16, resulting in a structure largely as described and illustrated with respect to FIG. 1. In a step, 1702, flexible and resilient material such as silicone is adhered to the outer shell fabric. A pocket slit may be cut, in a step 1704, through the flexible and resilient material and shell to provide access to the pocket. Edges of a pocket bag may be secured to the interior of an inner shell of the garment, in a step 1706, to construct the pocket bag behind and accessible through the pocket slit. It should be appreciated that the pocket bag may be secured by any of various attachment mechanisms including adhesives, sewing or other threaded attachments, clasps, mechanical fixtures (removable or non-removable), or the like. Accessory or crystal color may be adhered to the interior of the pocket bag, in a step 1708, by any of various adhering approaches as described herein (such as dying of interior fabric, placement of a color strip, use of a fitted color fabric, or the like). The frame may be used to provide support and structure to the pocket bag as described hereinbefore or a stand-alone pocket patch as described hereinafter. For example, when the pocket bag is intended to be a stand-alone container, the frame ensures stability and structural support for the pocket bag. As a result, the pocket bag may be adhered directly to a practitioner's body, to athleisure wear and/or to personal items.

Figure 18:
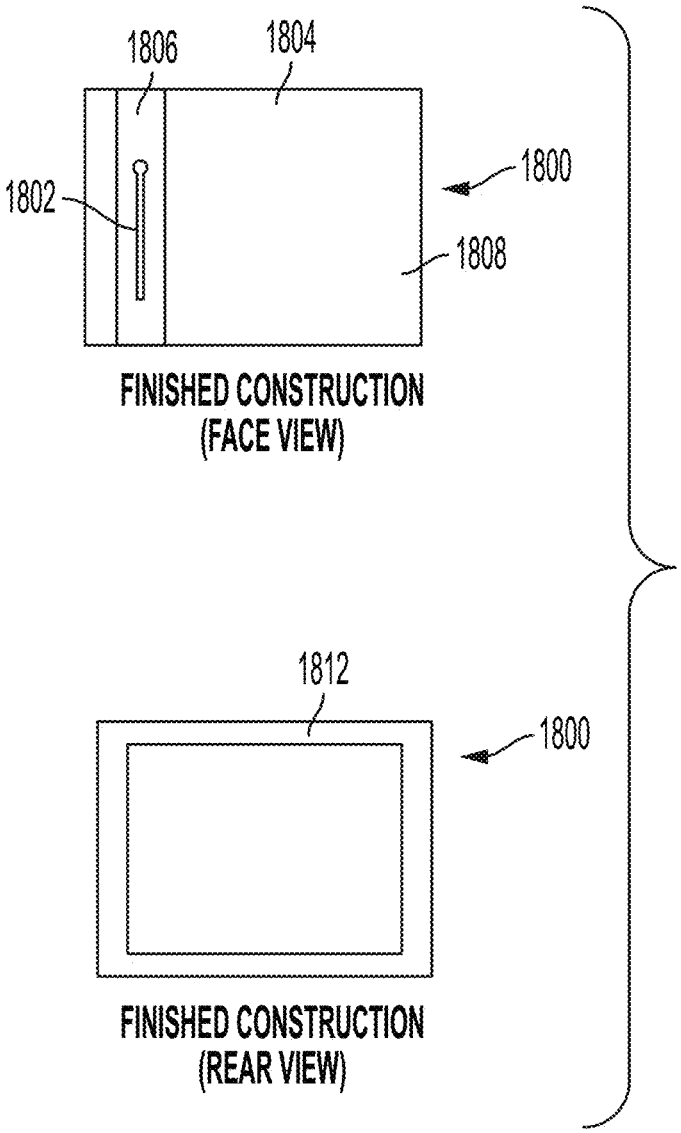
FIG. 18 illustrates a block diagram of a chakra crystal pocket construction for stand-alone use according to the disclosure.

For example, as illustrated in a further embodiment shown in FIG. 18, an accessory pocket 1800 may be formed as a stand-alone pocket or patch. The outer shell fabric 1804 is a stand-alone piece of fabric. The accessory pocket 1800 formed as a stand-alone pocket or patch may include a film frame 1812 to provide support to the accessory pocket's structure. The accessory pocket 1800 once formed using the steps described above, and in further detail in FIGS. 16 and 17, may be adhered to a piece of athleisure wear or a personal possession by a practitioner. The accessory pocket 1800 as illustrated comprises an elastic pocket opening or slit 1802 for access and closure of a pocket according to the disclosure. As shown and described, the elastic pocket slit may be implemented in the form of a silicone slit adhered to an outer shell fabric 1804 such as the garment fabric. The silicone slit 1802 may take the form of a strip 1806 of silicone material, e.g., of a width of approximately ¾ inch, printed over (or otherwise adhered to) the outer shell fabric 1804. The slit 1802 may be laser cut through both the silicone strip and underlying shell(s) material. The elastic pocket opening or slit 1802 provides access to a pocket bag, 1808 formed behind and beneath the pocket slit 1802. The pocket bag 1808 may be dimensioned to accommodate a chakra crystal or stone. The practitioner may also directly adhere the accessory pocket 1800 to the practitioner's body to maximize proximity to their chakra location. As a result, the practitioner may align the accessory pocket 1800 with their personal chakra structure for a more personalized experience. In a still further embodiment, the stand-alone accessory pocket 1800 may be configured to adhere to personal accessories. In this way, a practitioner may carry their chakra crystal and/or other personal effects even when not wearing the above-described athleisure wear. The stand-alone pocket or patch embodiment may be applied to a water bottle, a swim towel, a bag such as a handbag or golf bag, a phone case, jewelry, shoes, and/or other personal accessories. As a result, a practitioner may keep the chakra crystal close by at all times during normal daily activities. The presence of the chakra crystal, as discussed elsewhere in the disclosure, promotes the health of the practitioner.

A family conscious practitioner may also apply an embodiment of the chakra pocket/pouch to home goods such as candles, night lights, home furnishings, phones, humidifiers/dehumidifiers, beds and associated sheets/pillows, and books to promote wellness while in the home. In a further embodiment, the chakra pouch may be applied to children's toys such as a plush teddy bear, blanket, night lights, toy cars, dolls, playsets, and bath toys such as rubber duckies. During holidays such as Halloween, the chakra pocket/pouch may be applied to costumes, for example a pirate outfit may feature at least an embodiment of the pouch on the toy sword and/or eyepatch or pirate hat. An astronaut costume may feature an embodiment of the pouch on the helmet. Thereby allowing a celebrant of the holiday to promote their health even while indulging in sweets and an overabundance of food.

Additional embodiments may be designed for use around the home, for example on a bath towel or oven mitt. Further embodiments may be designed for adhering to sports equipment such as golf bags, swimsuits, tennis rackets, badminton rackets, shuffleboard pucks, lacrosse sticks, baseball gloves and mitts, golf clubs, and soccer cleats. As discussed above, a practitioner may also adhere an embodiment of the crystal patch to items around their home and/or in their family's lives to ensure the wellbeing of the household. Further embodiments of the disclosure may be adhered to other articles such as vehicles, doors, a mailbox, a desk, and exercise equipment to ensure maximized transmission of the chakra energies throughout the practitioner's life experience.

In an embodiment, the pocket bag 108 may be alternately sized and used to accommodate personal belongings in place of or in addition to the chakra crystal or stone. The pocket bag 108, in pouch, pocket, or patch embodiments, may be used to contain, alone or in addition to a chakra crystal, gemstones, minerals, crystals, rocks, charms of various metals and other materials, beads, pearls, and worry dolls. The pocket bag 108 may also be sized to hold personal effects such as glasses, wallet, phone, keys, identification materials, and music players.

Some examples have been discussed above but should not be construed as an exhaustive list. The health of a practitioner is promoted by the presence of the chakra crystal and the crystal pocket/pouch/patch of the disclosure is intended to facilitate an easy method of keeping at least one chakra crystal near or on the practitioner's person as often as possible. The present disclosure seeks to promote the health of the practitioner by allowing the practitioner the ability to adhere the patch to objects they interact with to ensure their wellbeing and optimized health.

Although the present disclosure and its advantages have been described in detail, it should be understood that various changes, substitutions and alterations can be made herein without departing from the technology of the disclosure as defined by the appended claims. For example, relational terms, such as "above" and "below" may be used with respect to components. Of course, if the component is inverted, above becomes below, and vice versa. Additionally, if oriented sideways, above and below may refer to sides of a component. Moreover, the scope of the present application is not intended to be limited to the particular configurations of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding configurations described herein may be utilized according to the present disclosure. Accordingly, the appended claims are intended to include within their scope such processes, machines, manufacture, compositions of matter, means, methods, or steps.

Those of skill in the art should further appreciate that the various illustrative blocks or steps skilled artisans may implement the described functionality in varying ways for each particular application, but such implementation decisions should not be interpreted as causing a departure from the scope of the present disclosure.

The description of the disclosure is provided to enable any person skilled in the art to make or use the disclosure. Various modifications to the disclosure will be readily apparent to those skilled in the art, and the generic principles defined herein may be applied to other variations without departing from the spirit or scope of the disclosure. Thus, the disclosure is not intended to be limited to the examples and designs described herein but is to be accorded the widest scope consistent with the principles and novel features disclosed herein.

Although several embodiments have been described in detail for purposes of illustration, various modifications may be made without departing from the scope and spirit of the present disclosure. Accordingly, the disclosure is not to be limited by the examples presented herein, but is envisioned as encompassing the scope described in the appended claims and the full range of equivalents of the appended claims.

What is claimed is:

1. A garment comprising:

an outer shell fabric;

a pocket for containing a chakra crystal, the pocket comprising:

a silicone print adhered to the outer shell fabric;

a laser cut pocket slit through the silicone print and the outer shell fabric forming an elastic pocket opening;

a pocket bag located behind and beneath the laser cut pocket slit, with vertical edges of the pocket bag secured to a back interior side of the outer shell fabric with seam-seal tape, the pocket bag being accessible through the laser cut pocket slit, and a color-coded strip adhered to an interior of the pocket bag, the interior being padded and the color-coded strip being at least partially visible from an exterior of the pocket, with the laser cut pocket slit and the pocket bag dimensioned to accommodate the chakra crystal and retain the chakra crystal in the pocket bag; and the pocket configured to correspond to a chakra gland of a wearer of the garment.

2. The garment of claim 1, wherein the silicone print adhered to the outer shell fabric is a strip of silicone ¾ inches wide.

3. The garment of claim 1, wherein the outer shell fabric is formed of a wicking material.

4. A garment comprising:

an outer shell fabric;

a pocket for containing a chakra crystal, the pocket comprising:

a clear silicone print adhered to the outer shell fabric;

a laser cut pocket slit through the clear silicone print and the outer shell fabric forming an elastic pocket opening;

a pocket bag located behind and beneath the laser cut pocket slit, with vertical edges of the pocket bag secured to a back interior side of the outer shell fabric with seam-seal tape, the pocket bag being accessible through the laser cut pocket slit, and a color-coded strip adhered to an interior of the pocket bag, the interior being padded and the color-coded strip being at least partially visible from an exterior of the pocket, with the laser cut pocket slit and the pocket bag dimensioned to accommodate the chakra crystal and retain the chakra crystal in the pocket bag; and the pocket configured to correspond to a chakra gland of a wearer of the garment.

5. The garment of claim 4, wherein the clear silicone print adhered to the outer shell fabric is a strip of silicone ¾ inches wide.

6. The garment of claim 4, wherein the outer shell fabric is formed of a wicking material.

* * * * *